US008997288B2

(12) United States Patent
Kim

(10) Patent No.: US 8,997,288 B2
(45) Date of Patent: Apr. 7, 2015

(54) METHOD OF CONTROLLING DRAINAGE OF WASH WATER REMAINING IN A WASHING MACHINE

(75) Inventor: Jao Bang Kim, Gyeonggi-do (KR)

(73) Assignee: Daewoo Electronics Corporation, Seoul (KR)

( * ) Notice: Subject to any disclaimer, the term of this patent is extended or adjusted under 35 U.S.C. 154(b) by 1125 days.

(21) Appl. No.: 12/435,746

(22) Filed: May 5, 2009

(65) Prior Publication Data

US 2009/0277505 A1 Nov. 12, 2009

(30) Foreign Application Priority Data

May 6, 2008 (KR) ..... 10-2008-0041811

(51) Int. Cl.

| | |
|---|---|
| ***D06F 35/00*** | (2006.01) |
| ***D06F 39/08*** | (2006.01) |
| ***A47L 15/42*** | (2006.01) |
| *D06F 33/02* | (2006.01) |

(52) U.S. Cl.

CPC ..... *D06F 39/083* (2013.01); *A47L 15/4217* (2013.01); *D06F 35/008* (2013.01); *D06F 33/02* (2013.01)

(58) Field of Classification Search

CPC .. A47L 15/4217; D06F 35/008; D06F 39/083
USPC ..... 8/158, 159; 168/12.05, 12.14, 12.19, 168/12.21, 208
See application file for complete search history.

(56) References Cited

U.S. PATENT DOCUMENTS

| | | | | |
|---|---|---|---|---|
| 2004/0154349 | A1* | 8/2004 | Ryo | 68/12.02 |
| 2005/0097924 | A1* | 5/2005 | Kim et al. | 68/12.05 |
| 2008/0245392 | A1* | 10/2008 | Park | 134/18 |

FOREIGN PATENT DOCUMENTS

DE 10014871 A1 * 10/2001

OTHER PUBLICATIONS

Machine Translation of Ennen, DE10014871A1, Oct. 2001.*

* cited by examiner

*Primary Examiner* — David Cormier

(57) ABSTRACT

Disclosed herein is a method of controlling drainage of wash water remaining in a washing machine. The method includes draining wash water from a tub to an outside of the washing machine, supplying wash water into the washing machine after the draining wash water, and re-draining the wash water to the outside of the washing machine after the supplying wash water.

13 Claims, 6 Drawing Sheets

METHOD OF CONTROLLING DRAINAGE OF WASH WATER REMAINING IN A WASHING MACHINE

CROSS-REFERENCE TO RELATED APPLICATIONS

The present application claims priority to Korean patent application number 10-2008-0041811, filed on May 6, 2008, which is incorporated by reference in its entirety.

BACKGROUND OF THE INVENTION

1. Field of the Invention

The present invention relates to a method of controlling drainage of wash water remaining in a washing machine and, more particularly, to a method of controlling drainage of wash water remaining in a washing machine to reduce an amount of wash water and time for a rinsing cycle while improving efficiency of the rinsing cycle.

2. Description of the Related Art

Generally, a washing machine refers to an electronic appliance that automatically washes laundry with wash water. The washing machine receives the wash water from outside and drains the wash water outside the washing machine after washing operation.

In a drum washing machine, a drum is rotatably disposed inside a tub that defines an inner space for receiving the wash water. The wash water is drained from the tub to the outside through a drainage device communicating with the tub.

When draining the wash water from the tub to the outside, a drain hose located at a lower side of the tub allows natural draining by head drop. However, if the drain hose is located higher than the lower side of the tub, it is necessary to perform coercive draining using a drain pump.

A conventional washing machine uses the drain pump to drain contaminated wash water before a rinsing cycle. In this case, the contaminated wash water is liable to remain in the drain hose due to deterioration in drainage capability of the drain pump and the like. As a result, clean wash water supplied to the tub is liable to be mixed with the contaminated wash water remaining in the drain hose, thereby reducing efficiency of the rinsing cycle while increasing the amount of wash water and time used for the rinsing cycle.

Therefore, there is a need to solve such problems of the washing machine.

SUMMARY OF THE INVENTION

The present invention is conceived to solve the problems as described above, and an aspect of the present invention is to provide a method of controlling drainage of wash water remaining in a washing machine to reduce the amount of wash water and time used for a rinsing cycle while improving efficiency of the rinsing cycle.

In accordance with one aspect of the present invention, a method of controlling drainage of wash water remaining in a washing machine includes draining wash water from a tub to an outside of the washing machine; supplying wash water into the washing machine after the draining wash water; and re-draining the wash water to the outside of the washing machine after the supplying wash water.

The supplying wash water may include supplying the wash water to a preset point of a drain hose.

The drain hose may be provided with a water level sensor detecting whether the wash water is supplied to the preset point of the drain hose.

The supplying wash water may include supplying the wash water for a preset period of time.

In accordance with another aspect of the present invention, a method of controlling drainage of wash water remaining in a washing machine includes draining wash water from a tub to an outside of the washing machine; determining whether the wash water remains in a drain hose after the draining wash water; supplying wash water into the washing machine if the wash water remains in the drain hose; and re-draining the wash water to the outside of the washing machine after the supplying wash water.

The drain hose may be provided with a remaining water level sensor detecting whether the wash water remains in the drain hose.

The supplying wash water may include supplying the wash water to a preset point of the drain hose.

The drain hose may be provided with a water level sensor detecting whether the wash water is supplied to the preset point of the drain hose.

The supplying wash water may include supplying the wash water for a preset period of time.

If the wash water does not remain in the drain hose, draining of the remaining wash water is terminated.

BRIEF DESCRIPTION OF THE DRAWINGS

The above and other aspects, features, and advantages of the present invention will become apparent from the following detailed description in conjunction with the accompanying drawings, in which.

DETAILED DESCRIPTION OF THE INVENTION

Hereinafter, exemplary embodiments of the present invention will be described in detail with reference to the accompanying drawings. It should be noted that the drawings are not to precise scale and may be exaggerated in thickness of lines or size of components for descriptive convenience and clarity. Furthermore, the terms used herein are defined by taking functions of the present invention into account and can be changed according to the custom or intention of users or operators. Therefore, definition of the terms should be made according to the overall disclosures set forth herein.

Figure 1:
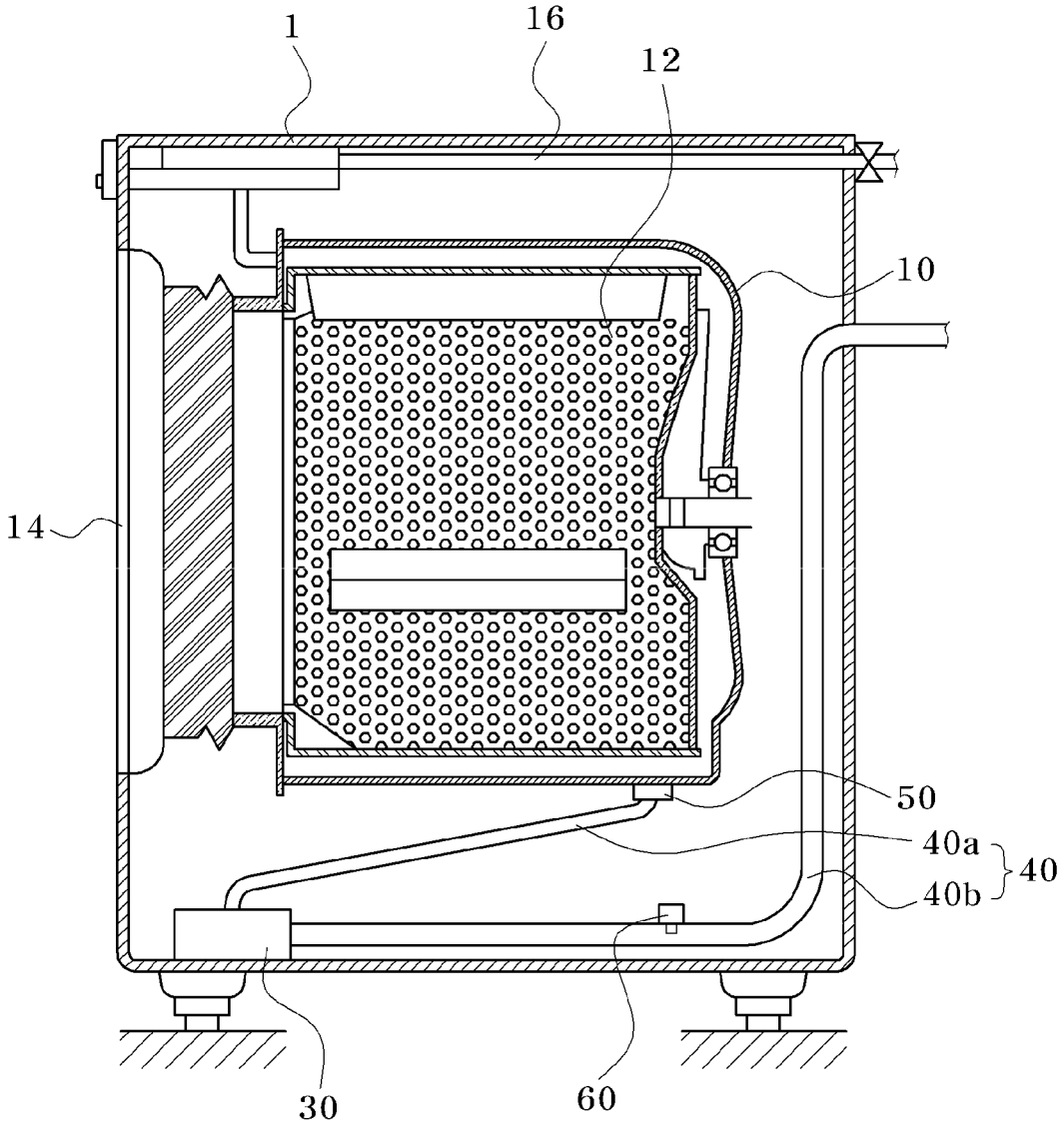
FIG. 1 is a sectional view of a washing machine according to one embodiment of the present invention.
Figure 2:
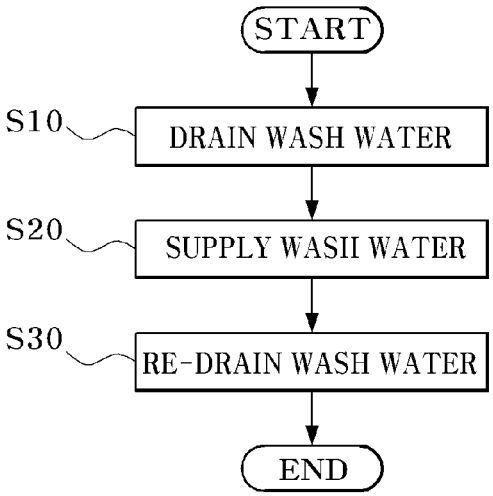
FIGS. 2 to 4 are flowcharts of a method of controlling drainage of wash water remaining in a washing machine according to one embodiment of the present invention.
Figure 3:
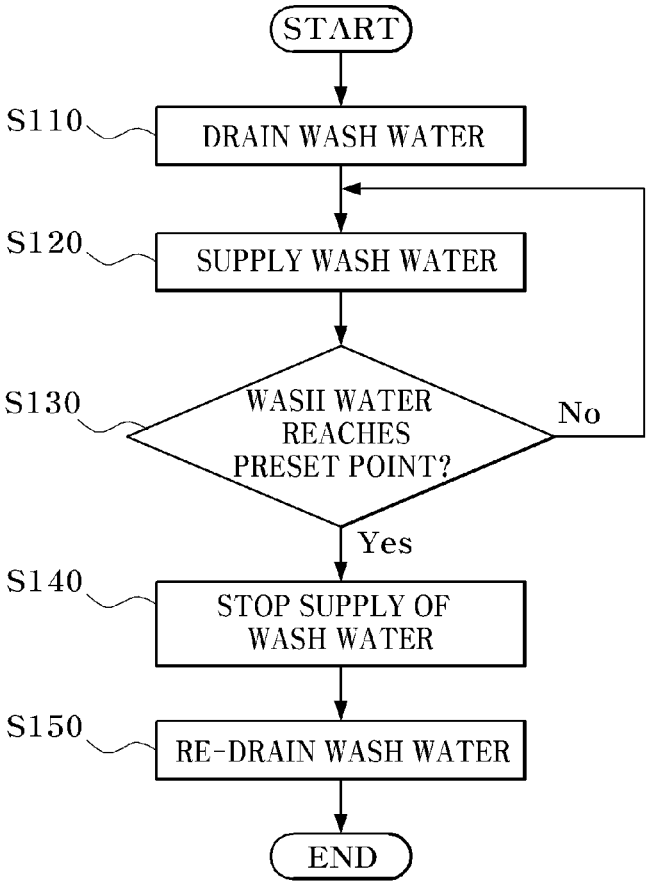
Figure 4:
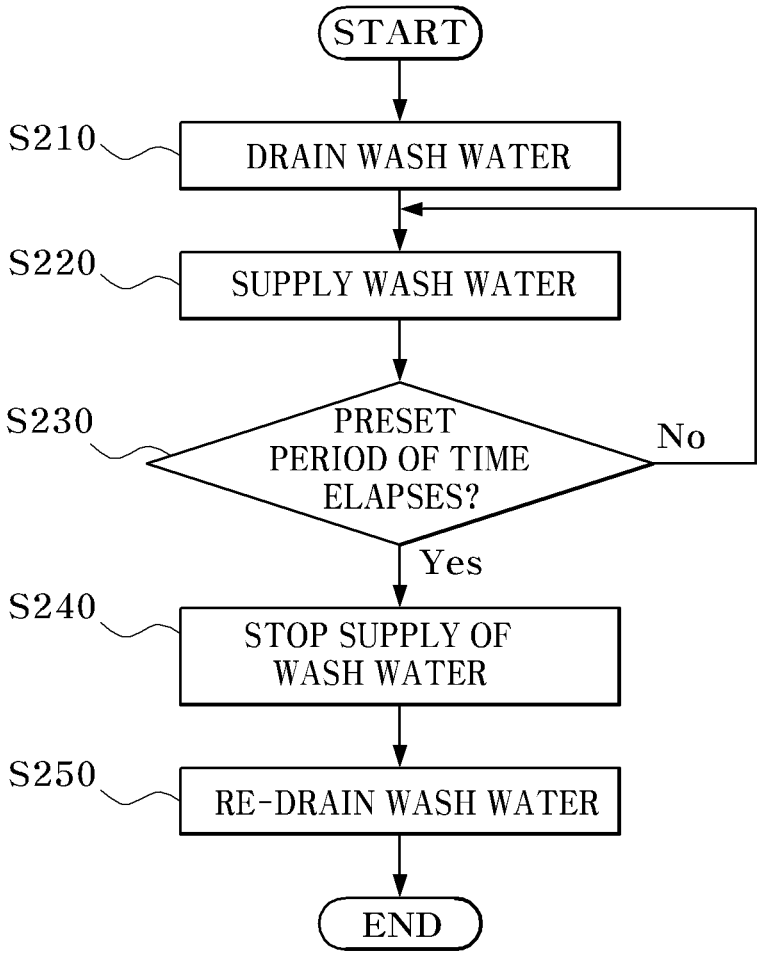
Figure 5:
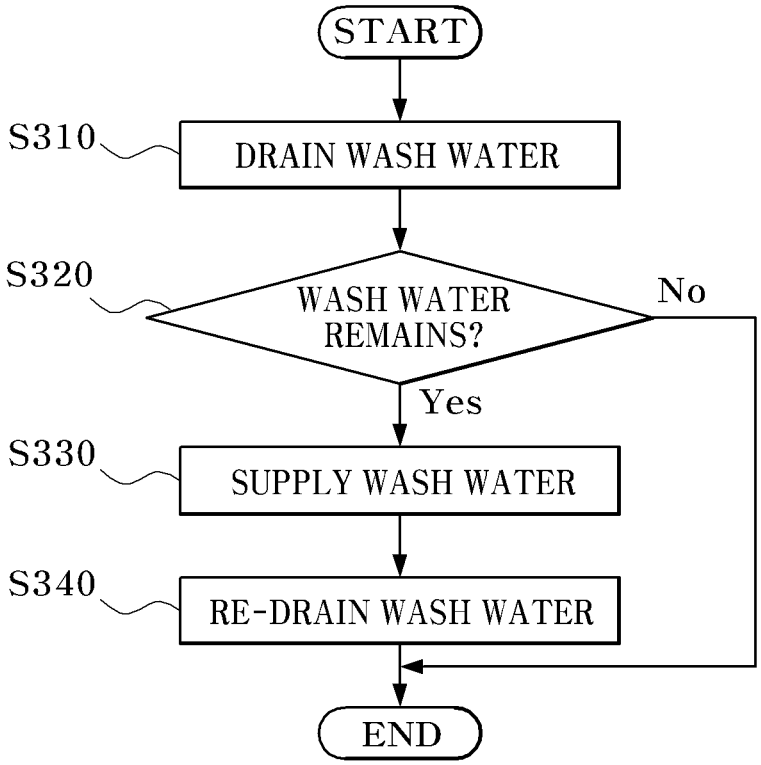
FIGS. 5 to 7 are flowcharts of a method of controlling drainage of wash water remaining in a washing machine according to another embodiment of the present invention.
Figure 6:
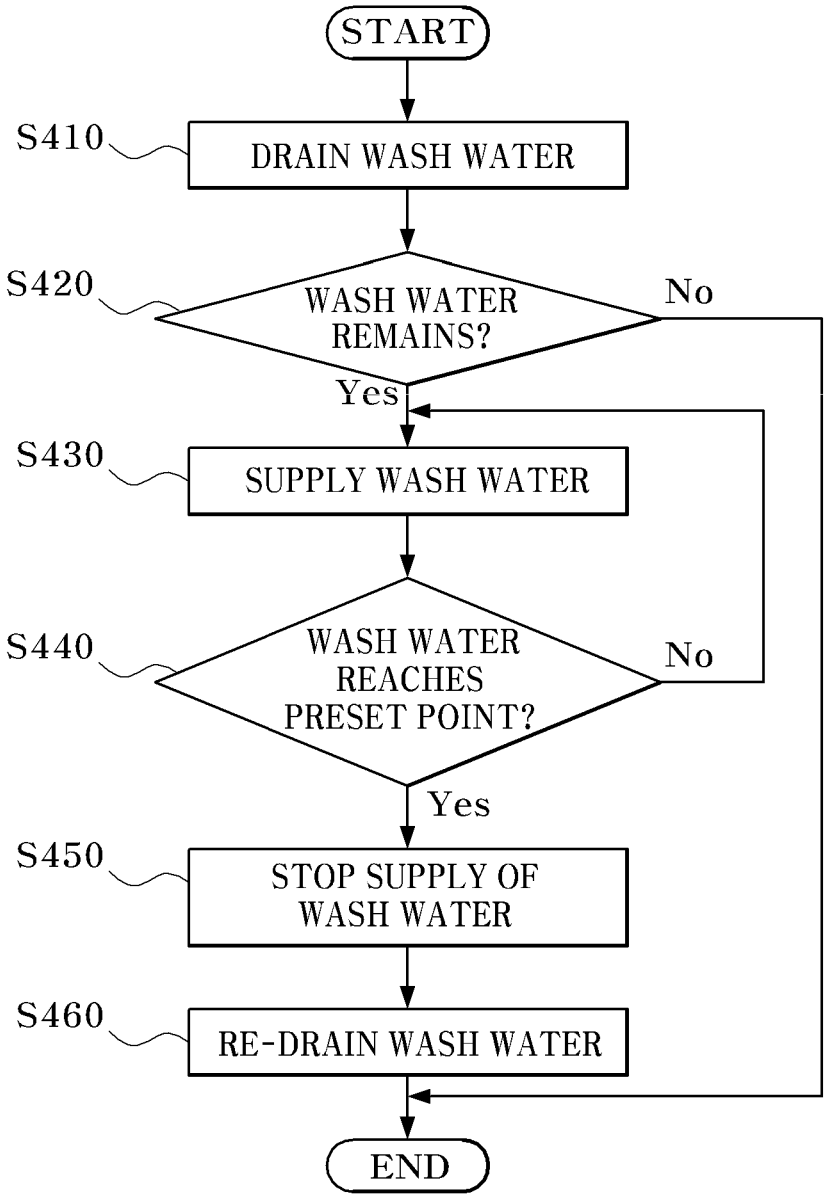
Figure 7:
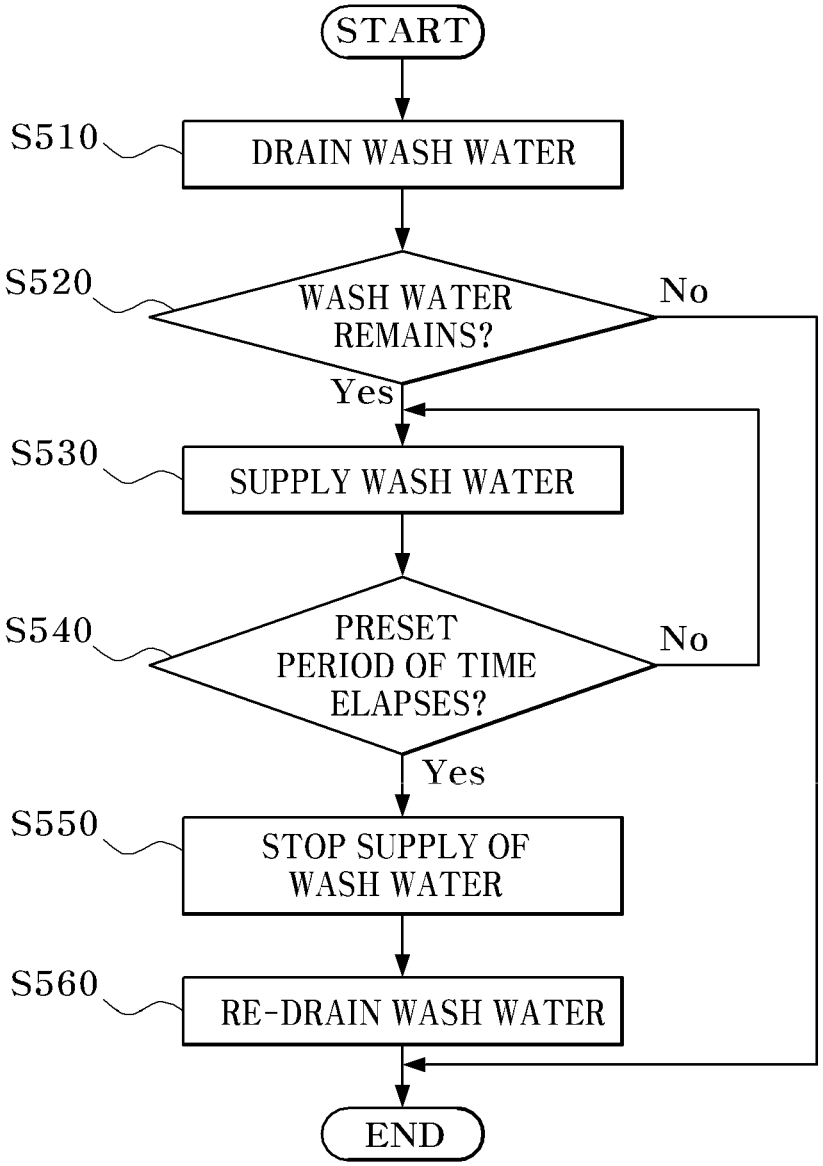

FIG. 1 is a sectional view of a washing machine according to one embodiment of the present invention, FIGS. 2 to 4 are flowcharts of a method of controlling drainage of wash water remaining in a washing machine according to one embodiment of the present invention, and FIGS. 5 to 7 are flowcharts of a method of controlling drainage of wash water remaining in a washing machine according to another embodiment of the present invention.

Referring to FIG. 1, a washing machine according to one embodiment of the invention includes a cabinet 1 that constitutes an outer appearance of the washing machine, a tub 10 disposed inside the cabinet 1 to receive wash water, a drum 12 rotatably disposed inside the tub 10 to receive laundry, and a door 14 opening and closing an opening formed on a front side of the cabinet 1.

Further, the washing machine according to this embodiment includes a water supply tube 16 connected to a water source outside the washing machine to supply wash water into the tub 10, a drain hose 40 connected at one end thereof to the tub 10 and extending at the other side thereof outside the cabinet 1, and a drain pump 30 provided to the drain hose 40 to forcibly drain the wash water from the tub 10 to the outside. The drain hose 40 serves to guide the wash water to the outside when the wash water is forcibly drained outside by the drain pump 30.

The drain hose 40 includes a first drain hose 40*a* and a second drain hose 40*b*. The first drain hose 40*a* is connected at one end thereof to the tub 10 and at the other end thereof to the drain pump 30. The second drain hose 40*b* is connected at one end thereof to the drain pump 30 and the other end of the second drain hose 40*b* extends outside the cabinet 1.

The drain hose 40 is provided with level sensors. Specifically, the second drain hose 40*b* is provided with a remaining water level sensor 60 which detects whether wash water remains in the second drain hose 40*b*, and the first drain hose 40*a* is provided with a water level sensor 50 which detects whether wash water is supplied to a preset point in the first drain hose 40*a*.

The remaining water level sensor 60 may be any type of sensor including contact and non-contact type sensors within the scope of the invention so long as it can detect the wash water remaining in the second drain hose 40*b*. Since the configuration and operational principle of such a sensor is apparent to those skilled in the art, a detailed description thereof will be omitted herein. The water level sensor 50 may also be any type of sensor within the scope of the invention so long as it can detect that the wash water is supplied to the present point of the first drain hose 40*a*, and a detailed description thereof will be omitted herein.

Next, referring to FIGS. 1 to 4, a method of controlling drainage of wash water remaining in a washing machine according to one embodiment of the present invention will be described.

According to this embodiment, the method includes draining wash water from the tub 10 to the outside of the cabinet 1 in S10, supplying wash water into the washing machine after the draining wash water in S20, and re-draining the wash water outside the cabinet 1 after the supplying wash water in S30.

Draining wash water in S10 is performed to drain the wash water from the tub 10 to the outside of the cabinet 1 by operating the drain pump 30. That is, the wash water received in the tub 10 is drained outside the cabinet 1 by the operation of the drain pump 30. Draining may be completed in one step or may be performed twice or more to increase a draining rate.

Supplying wash water in S20 is performed to supply wash water into the drain hose 40. In this operation, wash water is newly supplied into the tub 10 through the water supply tube 16 and is then supplied into the drain hose 40 which communicates with the tub 10.

Re-draining the wash water in S30 is performed to drain the wash water from the drain hose 40 to the outside of the cabinet 1 by operating the drain pump 30. That is, the wash water in the drain hose 40 is re-drained from the cabinet 1 by the operation of the drain pump 30. Re-draining may be performed once or more according to user selection.

In this way, contaminated wash water remaining in the drain hose 40 is discharged from the washing machine before a rinsing cycle, so that wash water newly supplied into the tub 10 can be prevented from being mixed with the contaminated wash water, thereby improving efficiency of the rinsing cycle. Furthermore, it is possible to reduce the amount of wash water and time used for the rinsing cycle.

Next, an operational principle of the method of controlling drainage of wash water remaining in the washing machine according to this embodiment will be described in detail with reference to FIGS. 3 and 4. Herein, a description of the same operations as those described above will be omitted.

According to this embodiment, the method includes draining wash water from the tub 10 to the outside of the cabinet 1 in S110, supplying wash water into the washing machine after the draining wash water in S120, determining whether the wash water is supplied to a preset point of the drain hose 40 in S130, stopping supply of the wash water if the wash water is supplied to the preset point of the drain hose 40 in S140, and re-draining the wash water outside the cabinet 1 after the stopping supply of the wash water in S150.

The determination in S130 is made through the water level sensor 50 provided to the drain hose 40. The water level sensor 50 is disposed at a preset point in the drain hose 40 to detect that wash water reaches the preset point of the drain hose 40, and sends the detection result to a controller (not show).

The controller stops supply of the wash water if the wash water is supplied to the preset point of the drain hose 40 in S140, and then allows re-draining of the wash water in S150. If the wash water is not supplied to the preset point of the drain hose 40, the controller allows additional supply of the wash water in S120.

Here, the preset point of the drain hose 40 refers to a certain point in the drain hose 40 which will be filled with wash water for efficient re-draining of the wash water. In this embodiment, since the preset point of the drain hose 40 is set to an upper end of the first drain hose 40*a*, the supply of the wash water is stopped when the wash water reaches the upper end of the first drain hose 40*a*.

If the drain pump 30 is a high performance pump, the preset point of the drain hose 40 may be set lower than a typical case with reference to a bottom surface of the cabinet 1. If the drain pump 30 is a low performance pump, the preset point of the drain hose 40 may be set higher than the case of the high performance pump. As such, the preset point of the drain hose 40 may be suitably changed according to the performance of the drain pump 30.

In this way, wash water can be supplied in a desired amount for re-draining, thereby reducing the amount of the wash water and time used for re-draining.

According to one alternative embodiment, the method includes draining wash water from the tub 10 to the outside of the cabinet 1 in S210, supplying wash water into the washing machine after the draining wash water in S220, determining whether supply of the wash water continues for a preset period of time or more in S230, stopping the supply of the wash water if the supply of the wash water continues for the preset period of time or more in S240, and re-draining the wash water outside the cabinet 1 after the stopping the supply of the wash water in S250.

The determination in S230 is performed through the controller. The controller stops the supply of the wash water if the supply of the wash water continues for the preset period of time or more in S240, and then allows re-draining of the wash water outside the cabinet 1 in S250. If the supply of the wash water is performed less than the preset period of time, the controller allows additional supply of the wash water in S220.

Here, the preset period of time refers to time for the drain hose 40 to be filled with wash water to guarantee efficient re-draining of wash water. In this embodiment, the preset period of time refers to time for the upper end of the first drain hose 40 to be filled with the wash water. If the preset period of time is 30 seconds, the supply of wash water is stopped after 30 seconds elapses. The preset period of time may be suitably changed according to the amount of wash water supplied for an hour.

In this way, wash water can be supplied in a desired amount for re-draining, thereby reducing the amount of the wash water and time for re-draining.

Next, a method of controlling drainage of wash water remaining in a washing machine according to another embodiment will be described with reference to FIGS. 1, and 5 to 7. Herein, a description of the same operations as those of the above embodiment will be omitted.

According to this embodiment, the method of controlling drainage of wash water remaining in the washing machine includes draining wash water from the tub 10 to the outside of the cabinet 1 in S310, determining whether the wash water remains in the drain hose 40 after the draining wash water in S320, supplying wash water if the wash water remains in the drain hose 40 in S330, and re-draining the wash water outside the cabinet 1 after the supplying wash water in S340.

The determination in S320 is made through the remaining water level sensor 60 provided to the drain hose 40. Specifically, the remaining water level sensor 60 is provided to the second drain hose 40*b* to detect if wash water remains in the second drain hose 40*b*, and sends the detection result to the controller.

The controller allows supply of the wash water if the wash water remains in the second drain hose 40*b* in S330, and then allows re-draining of the wash water in S340. If wash water does not remain in the second drain hose 40*b*, the controller terminates the cycle.

In this way, whether the wash water remains in the drain hose 40 is detected before newly supplying wash water after draining the wash water, thereby preventing possible unnecessary operation in the case where the wash water does not remain therein.

Next, an operational principle of the method of controlling drainage of wash water remaining in the washing machine according to this embodiment will be described in detail with reference to FIGS. 6 and 7. Herein, a description of the same operations as those described above will be omitted.

According to this embodiment, the method includes draining wash water from the tub 10 to the outside of the cabinet 1 in S410, determining whether the wash water remains in the drain hose 40 after the draining wash water in S420, supplying wash water if the wash water remains in the drain hose 40 in S430, determining whether the wash water is supplied to a preset point of the drain hose 40 in S440, stopping supply of the wash water if the wash water is supplied to the preset point of the drain hose 40 in S450, and re-draining the wash water outside the cabinet 1 after the stopping supply of the wash water in S460. Here, if the wash water does not remain in the drain hose 40, the cycle is terminated.

The determination in S440 is made through the water level sensor 50 provided to the drain hose 40. The water level sensor 50 is disposed at a preset point in the drain hose 40 to detect that the wash water reaches the preset point of the drain hose 40, and sends the detection result to the controller.

The controller stops the supply of the wash water if the wash water is supplied to the preset point of the drain hose 40 in S450, and then allows re-draining of the wash water in S460. If the wash water is not supplied to the preset point of the drain hose 40, the controller allows additional supply of the wash water in S430.

In this way, the wash water can be supplied in a desired amount for re-draining, thereby reducing the amount of the wash water and time used for re-draining.

According to one alternative embodiment, the method includes draining wash water from the tub 10 to the outside of the cabinet 1 in S510, determining whether the wash water remains in the drain hose 40 after the draining wash water in S520, supplying wash water if the wash water remains in the drain hose 40 in S530, determining whether supply of the wash water continues for a preset period of time or more in S540, stopping the supply of the wash water if the supply of the wash water continues for the preset period of time or more in S550, and re-draining the wash water outside the cabinet 1 after the stopping the supply of the wash water in S560. If the wash water does not remain in the drain hose, the controller terminates the cycle.

The determination in S540 is made through the controller. The controller stops the supply of the wash water if the supply of the wash water continues for the preset period of time or more in S550, and then allows re-draining of the wash water in S560. If the supply of the wash water is performed less than the preset period of time, the controller allows additional supply of the wash water in S530.

In this way, the wash water can be supplied in a desired amount for re-draining, thereby reducing the amount of the wash water and time used for re-draining.

As apparent from the above description, in the method according to one embodiment, contaminated wash water remaining in a drain hose is drained to the outside before a rinsing cycle, so that wash water newly supplied to the tub may be prevented from being mixed with the contaminated wash water, thereby reducing the amount of wash water and time used for a rinsing cycle while improving efficiency of the rinsing cycle.

Further, according to one embodiment, wash water may be supplied to the tub in a desired amount corresponding to the amount of wash water used during re-draining, thereby reducing the amount of wash water and time for re-draining.

Moreover, according to one embodiment, it is determined whether wash water remains in the drain hose before newly supplying wash water and after draining the wash water, thereby preventing possible unnecessary operation when the wash water does not remain in the drain hose.

Although some embodiments have been provided to illustrate the present invention in conjunction with the accompanying drawings, it will be apparent to those skilled in the art that the embodiments are given by way of illustration only, and that various modifications and equivalent embodiments can be made without departing from the spirit and scope of the present invention. Further, the description of the drum washing machine as provided herein is only one example of the present invention, and the present invention can be applied to other devices. Accordingly, the scope and spirit of the present invention should be limited only by the following claims.

What is claimed is:

1. A method of controlling drainage of water from a washing machine, comprising:

draining contaminated water from a tub of the washing machine using a drain hose;

after draining the contaminated water, determining whether any of the contaminated water is at a first preset point in the drain hose;

when the contaminated water is at the first preset point in the drain hose, supplying clean water into the washing machine (i) to a second preset point in the drain hose above the first preset point or (ii) for a preset period of time and, after supplying the clean water, draining the clean water from the washing machine; and after draining the clean water, rinsing laundry in the washing machine, wherein the clean water is supplied to the second preset point of the drain hose, wherein a first water level sensor determines whether any of the contaminated water is at the first preset point in the drain hose, and wherein a second water level sensor determines whether any of the contaminated water is at the second preset point in the drain hose.

2. The method of claim 1, further comprising, before draining first water, washing laundry in the washing machine, resulting in the contaminated water being the tub.

3. The method of claim 1, wherein the clean water is supplied for the preset period of time.

4. The method of claim 3, wherein the preset period of time is a period of time for the drain hose to be filled with the clean water.

5. The method of claim 1, wherein the first water level sensor is at the first preset point in the drain hose.

6. The method of claim 1, wherein the second water level sensor is at the second preset point in the drain hose.

7. The method of claim 6, wherein the second preset point in the drain hose is at an upper end of the drain hose.

8. The method of claim 1, wherein the contaminated water is drained from the drain hose by operating a drain pump.

9. The method of claim 8, wherein the clean water is drained from the drain hose by operating the drain pump.

10. The method of claim 1, further comprising repeating supplying clean water into the washing machine and draining the clean water from the washing machine when contaminated water is detected in the drain hose.

11. A washing machine, comprising:

a tub configured to contain contaminated wash water and clean rinse water;

a drain hose at a bottom of the tub;

a first water level sensor at a first preset point in the drain hose;

a second water level sensor at a second preset point in the drain hose above the first preset point;

a controller configured to determine whether any contaminated wash water is at the first preset point in the drain hose after the contaminated wash water is drained from the tub, and when the contaminated wash water is at the first preset point in the drain hose, supply clean water into the tub to the second preset point in the drain hose, drain the clean water from the tub, then supply the clean rinse water to the tub; and a drain pump that drains the contaminated wash water, the clean water, and the clean rinse water from the tub.

12. The washing machine of claim 11, further comprising a cabinet that constitutes an outer appearance of the washing machine, a drum inside the tub to receive laundry, and a door opening and closing an opening on a front side of the cabinet.

13. The washing machine of claim 11, further comprising a water supply tube connected to a water source to supply water into the tub.

* * * * *